US006402135B1

(12) United States Patent
Werner

(10) Patent No.: US 6,402,135 B1
(45) Date of Patent: Jun. 11, 2002

(54) SHEET FEEDER FOR HANDLING SHEETS OF VARYING THICKNESS

(76) Inventor: Todd C. Werner, 1400 49th Ave. NE., St. Petersburg, FL (US) 33703

( * ) Notice: Subject to any disclaimer, the term of this patent is extended or adjusted under 35 U.S.C. 154(b) by 0 days.

(21) Appl. No.: 09/385,500

(22) Filed: Aug. 27, 1999

(51) Int. Cl.[7] ..... B65H 3/04

(52) U.S. Cl. ..... 271/35; 271/117; 271/121; 271/131; 271/137

(58) Field of Search ..... 271/35, 38, 111, 271/117, 121, 131, 137, 124

(56) References Cited

U.S. PATENT DOCUMENTS 5,295,675 A * 3/1994 Hain ..... 271/121 X
5,451,038 A * 9/1995 Hosking et al. ..... 271/35 X
5,601,282 A * 2/1997 Milo et al. ..... 271/35 X
5,692,743 A * 12/1997 Yano et al. ..... 271/121
5,851,008 A * 12/1998 Dilanchian et al. ..... 271/35 X
5,913,512 A * 6/1999 Fritsche et al. ..... 271/34 X

* cited by examiner

*Primary Examiner*—Christopher P. Ellis
*Assistant Examiner*—Gene O. Crawford
(74) *Attorney, Agent, or Firm*—Ronald E. Smith; Smith & Hopen, P.A.

(57) ABSTRACT

A high-speed sheet feeder includes a separator wheel having a diameter of about three inches. A curved metal shroud having a low friction surface is disposed in close proximity to the wheel. The shroud has first and second straight parts that are disposed about ninety degrees relative to one another, and a curved part that interconnects the straight parts. The curvature substantially conforms to the curvature of the separator wheel. The second straight part of the shroud is parallel to a conveyor belt and has a slot formed in it so that the separator wheel engages sheets below the second straight part. The large diameter of the separator wheel, which is about double the diameter of prior art separator wheels, and the unique shape and extent of the shroud combine to enable a sheet feeder to handle sheets of widely varying thickness.

5 Claims, 2 Drawing Sheets

SHEET FEEDER FOR HANDLING SHEETS OF VARYING THICKNESS

BACKGROUND OF THE INVENTION

1. Field of the Invention

This invention relates, generally, to sheet feeders of the stand-alone type or of the type used in conjunction with other sheet feeders or as a part of other machines. More particularly, it relates to a sheet feeder capable of handling sheets of widely varying thickness.

2. Description of the Prior Art

There are many different types of sheet feeders and there are hundreds of uses for them. Typically, high speed sheet feeders are used when it is desired to insert sheets of paper or other flat items into envelopes, containers, bins or the like in large quantities and in short periods of time.

The primary parts of a sheet feeder include a bin for holding a stack or nearly vertical stack of sheets of paper or similar thin, flat items, a wedge-shaped support member at the bottom of the sheet feeder that tilts the stack of sheets from a vertical plane, a separator wheel near the bottom of the sheet feeder, a guide plate mounted adjacent to the separator wheel, and a conveyor belt at the bottom of the sheet feeder that transports sheets away from the sheet feeder as they are dispensed. A nip area is defined as an area between the lowermost point of the separator wheel and the conveyor belt. Each sheet of paper dispensed by the sheet feeder must pass through the nip area, one at a time, so that the lowermost sheets, as they are sequentially pulled from the bottom of the stack, are shingled when they are transported away from the feeder by the conveyor belt. The wedge-shaped support member biases the sheets toward the nip area.

U.S. Pat. No. 3,908,983 (1974) discloses a separator wheel, also known as a gate means, having a diameter of about one and one-quarter inches. Thus, its radius is about five-eighths of an inch. A straight guide plate is mounted between the separator wheel and the stack of paper in the sheet feeder bin; the guide plate is of smooth, metallic construction so that it presents a low friction surface so that paper slides easily relative to it. If the edges of the sheets of paper were to rub against the separator wheel as they approached the nip, they could get hung up on the relatively high friction surface presented by the separator wheel and thus fail to enter into the nip area.

If relatively thick items, such as audiocassettes, are to be inserted into containers or envelopes at high speeds, the separator wheel and guide plate just described cannot be used. That assembly has utility only in connection with relatively thin sheets because a large plurality of thin sheets can curve around the perimeter of the wheel and be constrained to enter into the staggered configuration as described above. However, if a stack of audio cassette tapes, each a quarter of an inch thick, is fed into a sheet feeder, the curvature of the small separator wheel presents a profile to the cassettes that is similar to the profile of a vertical flat wall; the machine thus cannot be used to dispense such thick items into containers or envelopes.

The obvious solution to this problem is to design different machines for high speed dispensing of thick articles into containers or envelopes; that is what the industry has been doing for the past twenty five years. Most of the machines that have been developed eschew the guide plate and the separator wheel/gate means and employ vacuum-reliant means and various other means for high-speed insertion of thick articles into envelopes. Those machines that retain the gate means concept simply increase the size of the nip area by adjusting the position of the gate means so that thicker sheets can run through the feeder. This patch applied to the problem is inadequate, however, and such machines jam at an unacceptable rate.

The machines that have been developed to handle the high speed feeding of thick articles without relying on a gate means have the opposite problem of the gate meansreliant machines; they do not handle thin articles well.

Moreover, they are of complex mechanical construction and thus are not inexpensive.

Those businesses having both thick and thin articles that require high speed dispensing of sheets or other articles into bins, containers, envelopes, or the like must purchase at least a first machine having a conventional small diameter separator wheel and a straight guide plate means for handling thin sheets and at least a second machine of different design for handling thick sheets or other thick articles.

There is a clear need for a high-speed sheet feeder capable of dispensing flat articles of widely differing thickness. This would enable many customers to purchase one machine for all their needs.

Scores if not hundreds of skilled machine designers have endeavored for the past quarter century to overcome the limitations of the known sheet feeders. The only successful attempts at overcoming the shortcomings, however, have resulted in entirely re-designed machines having no gate means whatsoever, as mentioned above.

Clearly, then, in view of the art considered as a whole at the time the present invention was made, it was not obvious to those of ordinary skill in this art how the limitations of gate means-reliant machines could be overcome in a way that would not require the invention of an entirely different machine.

SUMMARY OF THE INVENTION

The long-standing but heretofore unfulfilled need for an innovation that overcomes the limitations of the prior art is now met by a new, useful, and nonobvious invention.

The present invention is an improved sheet feeder for high speed dispensing of sheets of widely varying thickness into containers, envelopes or the like.

It includes a bin means for holding a plurality of sheets in a substantially vertical array and means for dispensing sheets in sequence from the bottom of the bin.

A novel gate means or separator wheel having a diameter of about three inches is positioned at the discharge end of the sheet feeder. A metallic shroud is positioned between the sheets in the bin and the separator wheel to provide a low friction surface to the sheets so that they do not become bound as they travel downwardly in the bin.

More particularly, the shroud has a first straight part, a curved part that conforms to a contour of the separator wheel and a second straight part disposed at a substantially ninety degree angle to the first straight part. The second straight part is disposed in parallel, predetermined spaced apart relation to a conveyor belt means that transports sheets from the sheet feeder.

The first straight part provides a smooth, low friction surface so that sheets traveling downwardly in the bin means as sheets are sequentially dispensed from a lowermost end of the bin means slide easily against the first straight part. The curved part of the shroud serves to shingle the sheets as they approach the nip area, thereby breaking frictional bonds that may have been holding contiguous sheets together. The second straight part of the shroud is slotted so that sheets entering into the nip area are contacted by the separator wheel, said separator wheel having a higher coefficient of friction relative to said sheets than said shroud member.

A wedge-shaped support means at the lowermost end of the bin biases the lowermost sheets in the stack toward the nip area.

It is a primary object of this invention to advance the art of sheet feeders by providing a sheet feeder capable of dispensing flat objects of widely varying thickness.

Another object is to provide such a machine in the absence of completely re-designing the machines heretofore capable of handling thin sheets and incapable of handling thick sheets.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
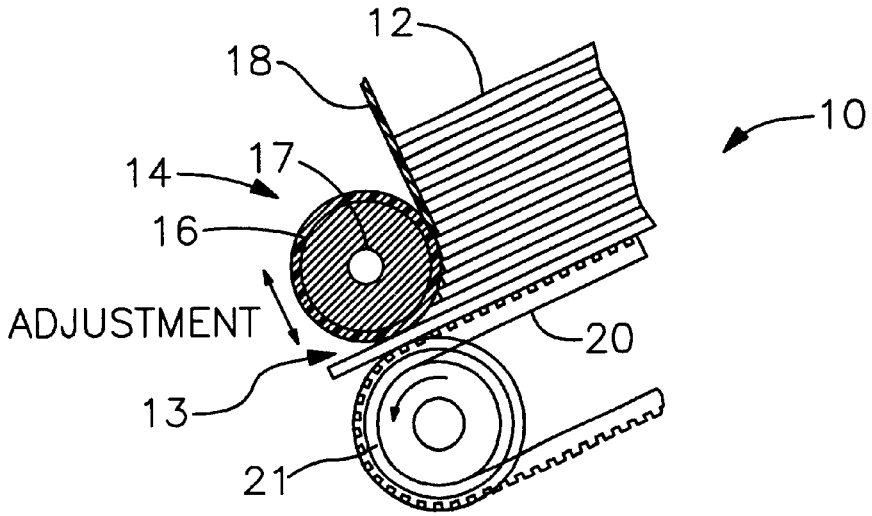
Fig. 1 Prior Art
FIG. 1 is a side elevational view of a sheet feeder of the prior art when handling thin sheets.

Referring now to FIG. 1, it will there be seen that a sheet feeder of the prior art is denoted 10 as a whole. Sheet feeder 10 includes a bin means, not shown, that holds a large plurality of individual sheets 12 in a substantially vertical array. Note the downward slant of the sheets, which biases them toward the nip area 13 of the feeder. That downward slant is provided by a wedge-shaped support surface, not shown.

The shingling means of the prior art is denoted 14 as a whole. It includes separator wheel/gate means 16 which has a diameter of about one and one-quarter inches and a radius of about five-eighths of an inch, and flat guide plate 18.

Typically, there are two wheels 16 disposed in laterally spaced relation to one another, only one of which is seen in this side view.

A plurality of sheet feeder conveyor belts 20, only one of which is seen in the side view of FIG. 1, is positioned at the discharge end of each sheet feeder. These belts, driven by nip rollers 21, dispense the lowermost sheet from the stack of sheets. The sheets may be dispensed into a container, onto a conveyor belt, or the like.

Sheets 12 are biased toward nip area 13 by an unillustrated wedge-shaped support member as mentioned earlier and are carried by belts 20 toward said nip area. Flat guide plate 18 is metallic and as such presents a low friction surface that enables the sheets to slide there against as they travel toward the nip area. Once the sheets arrive individually at the bottom of the stack, the high friction surface of the truncate conveyor belts 20 carries them into nip area 13 and dispenses them from the sheet feeder.

The prior art teaches that separator wheel 16 can be nonrotationally mounted, mounted for rotation in the direction of sheet travel, or mounted for rotation counter to the direction of sheet travel. If nonrotationally mounted, a flat will eventually wear into the circumference of the wheel and it will no longer dispense sheets. The wheel is typically provided with O-rings or other friction-enhancing means; accordingly, when a flat appears, the O-rings are changed. If rotationally mounted, the wheel rotates very slowly so that the same surface is not continually exposed to the wearing effects of the sheets.

As indicated in FIG. 1, this prior art machine operates quite well when dispensing thin sheets of paper or other very thin flat objects; note the shingling achieved by the sheets as they approach nip area 13. However, it should also be noted that guide plate 18 terminates its downward extension at a location substantially level with axle 17 of separator wheel 16. Therefore, the sheets that have passed below that point bear directly against wheel 16 and are thus subjected to increased frictional engagement. Slow rotation of the wheel in the direction of sheet travel can reduce that frictional engagement and keep the sheets moving downwardly toward the nip area.

There are also prior art machines, not shown, where guide plate 18 extends below the level of axle 17 and is curved in said extended area to conform to the curvature of the wheel. These curved guide plates do a better job of starting the shingling of the sheets, relative to a straight guide plate, but due to the small diameter of the wheel, the radius of curvature of the curved guide plate is small, the amount of pre-shingling is nominal, and the frictional bond between contiguous sheets is not adequately severed.

Figure 2:
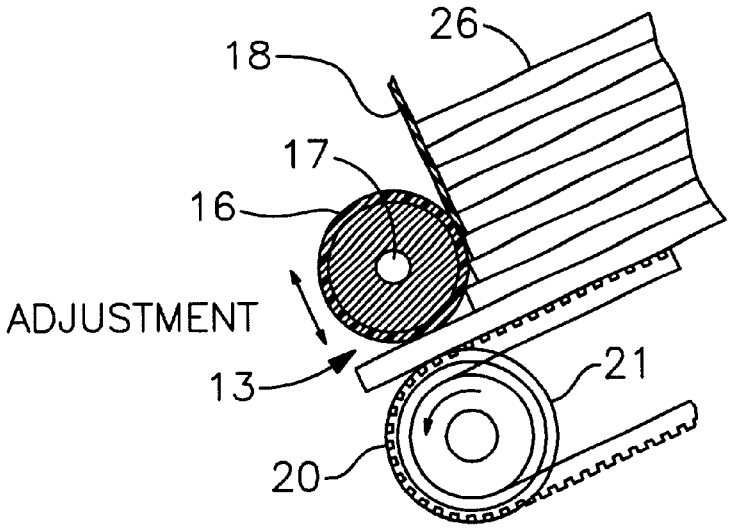
Fig. 2 Prior Art
FIG. 2 is a side elevational view of a sheet feeder of the prior art when handling thick sheets.

As indicated in FIG. 2 (prior art), thick sheets 26 do not follow the contour of separator wheel 16 to any significant degree. Thus, shingling is reduced to a minimum and the frictional bond between contiguous sheets is strong. No usable shingling of sheets 26 is created because wheel 16 acts much like a vertical flat wall. For this reason, alternative machines, not reliant upon separator wheels and guide plates, have been used for the past twenty five years to handle high speed dispensing of thick articles from sheet feeders. The device of FIG. 2 appears to work acceptably, in view of the double-headed adjustment arrow appearing therein. However, switching from a thin sheet to a thick sheet is not a simple matter of adjusting the position of separator wheel 16. The amount of pre-shingling made possible by the separator wheel of FIG. 2 is inadequate to break the bonding between contiguous sheets. Accordingly, frequent jamming occurs when thick sheets are fed into a separator wheel of small diameter is depicted in FIG. 2, i.e., the adjustment of the wheel upwardly to increase the size of the nip area does not adequately solve the jamming problem to any satisfactory degree of reliability.

Figure 3:
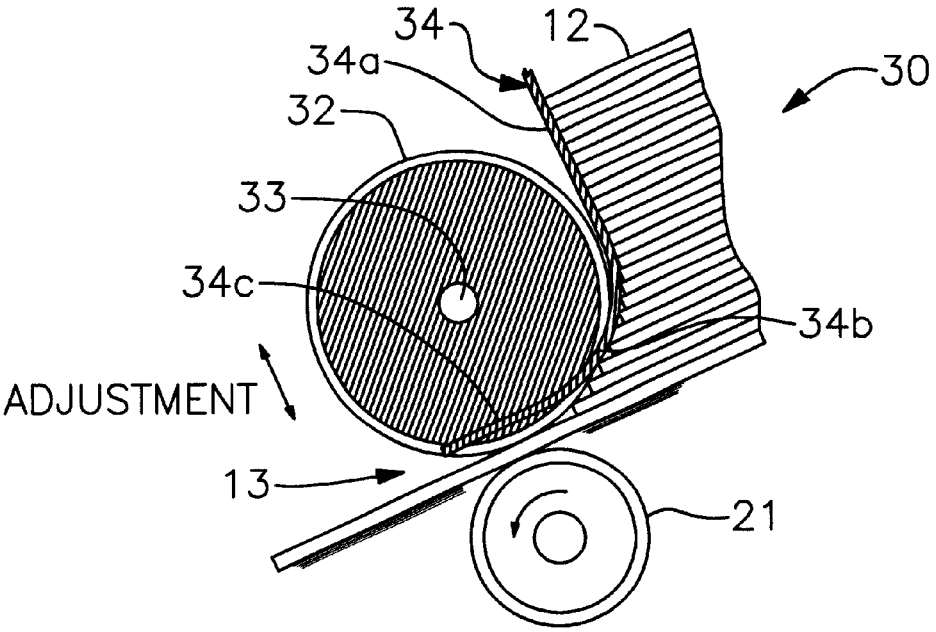
FIG. 3 is a side elevational view of the novel sheet feeder when handling thin sheets.

Referring now to FIG. 3, it will there be seen that an exemplary embodiment of the invention is denoted as a whole by the reference numeral 30.

Separator wheel/gate means 32 has a diameter of about three inches and a radius of about one and one-half inches. Curved metal plate or shroud 34 has a curved middle section **34*b* of corresponding curvature, which extends below center axle 33 of said wheel as depicted. Shroud 34 is straight as at 34***a* in the bin area and in the region of nip area 13 as at 34*c*; the two straight sections are disposed substantially at a ninety-degree angle with respect to one another.

Straight section 34*c* is parallel to truncate conveyor belt 20, being spaced therefrom a predetermined distance. A slot is formed in straight section 34*c* for each wheel 32 so that sheets arriving at the nip area 13 are exposed to the high friction surface of wheel 32. Accordingly, sheets approaching the bottom of the stack of sheets are subjected to the low friction surface of shroud 32 until they are ready to enter nip area 13.

A sheet exiting the bin means thus first bears against the straight part 34*a* of shroud member 34, secondly against the curved part 34*b* of said shroud member, and thirdly against separator wheel 32. In this way, the curvature of the shroud member imparts a first amount of shingling and the curvature of separator wheel 32 imparts a second amount of shingling that is complementary to the shingling provided by said curved part of the shroud member.

Note the large amount of staggering made possible when thin or relatively thin sheets are handled by separator wheel 32 and shroud 34. This is a function of the large radius of curvature of said wheel and shroud. This reduces jamming by increasing the pre-shingling of the sheets and thus reducing the frictional bond between contiguous sheets.

Figure 4:
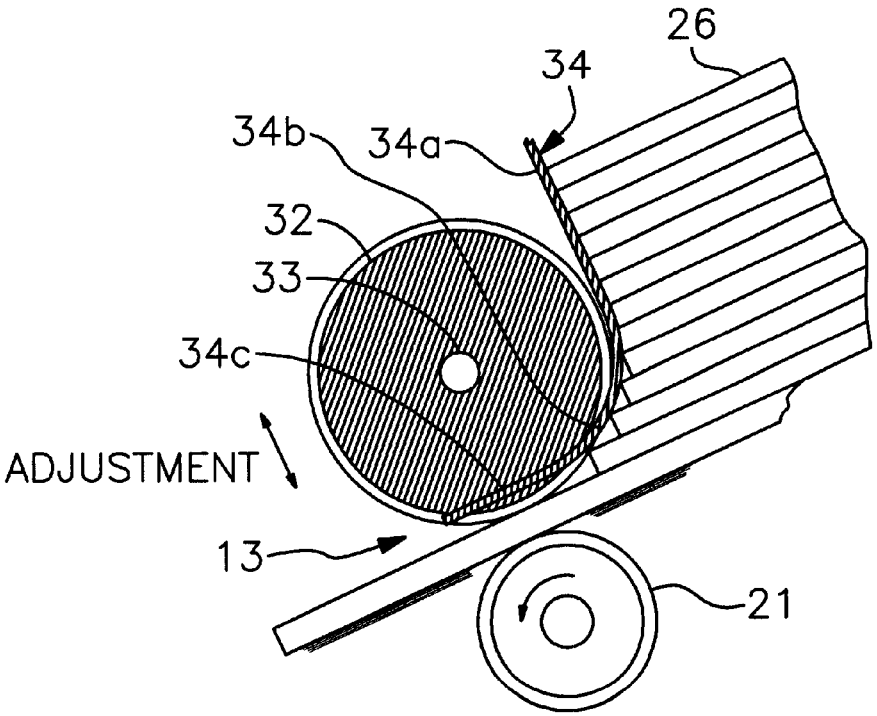
FIG. 4 is a side elevational view of the novel sheet feeder when handling thick sheets.

FIG. 4 depicts the novel gate means when handling thick or relatively thick articles 26. Note the large staggering made available by the increased curvature of shroud 34 and the increased diameter of separator wheel 32. The curvature of shroud 34 at 34*b* no longer presents a flat wall to the thick or relatively thick articles, and said articles are staggered prior to entering nip area 13 just as if they were thin sheets.

Separator wheel 32 may be nonrotationally mounted or rotationally mounted to reduce the formation of flats thereon. Wheel 32 is mounted for rotation into the sheets of paper, which direction is counterclockwise in FIGS. 3 and 4. This direction of rotation is made useful by the large amount of friction-breaking shingling achieved by novel separator wheel 32 and novel shroud 34. In a preferred embodiment, wheel 32 rotates eight thousands of an inch per second.

The increase in diameter of the separator wheel/gate means 32 as well as the extended extent and curvature of shroud 34 overcomes the shortcomings of the earlier sheet feeders, and no major re-designing of the sheet feeder is required to substantially enhance its versatility. A high-speed sheet feeder having the novel separator wheel and shroud can handle a wide range of thin and thick articles. There is no longer a need to purchase a first sheet feeder having a small diameter gate means for handling thin sheets and a second sheet feeder having a different gate means for handling thick sheets. Moreover, the novel gate means and shroud of this invention may be retrofit onto existing sheet feeders equipped with small diameter gate means and straight guide plates.

This invention represents a major breakthrough in the art of high-speed sheet feeders. Being drawn to a pioneering invention, the claims that follow are entitled, as a matter of law, to broad interpretation to protect the heart or essence of the invention from piracy.

It will thus be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described,

What is claimed is:

1. A sheet feeder for handling articles of differing thickness that ranges between the thickness of a sheet of paper to a thickness of approximately one-quarter inch, comprising:

a bin means for holding a plurality of articles in a substantially vertical array;

a conveyor belt means positioned adjacent a lowermost end of said bin means for removing a lowermost article from said bin means and dispensing it from said sheet feeder;

a separator wheel having a circular configuration positioned in predetermined spaced relation to said conveyor belt means;

said separator wheel having a diameter of about three inches so that articles ranging in thickness from as thin as a sheet of paper to as thick as about one-quarter inch are staggered when disposed against said shroud member;

a shroud member mounted adjacent said separator wheel between said separator wheel and said articles;

said shroud member having a first straight part, a curved part that substantially conforms to a contour of said separator wheel and that has a radius of curvature of about one and one-half inches so that articles ranging in thickness from as thin as a sheet of paper to as thick as about one-quarter inch are staggered when disposed against said shroud member and a second straight part disposed in parallel, predetermined spaced apart relation to said conveyor belt means;

a slot formed in said second straight section of said shroud member so that articles in said bin area are engaged by said separator wheel;

articles traveling downwardly in said bin means bearing first against said first straight part of said shroud member, secondly against said curved part of said shroud member, and thirdly against said separator wheel, said separator wheel providing a curvature that is complementary to the curvature provided by said shroud member;

whereby articles having a thickness ranging from the thickness of a sheet of paper up to approximately one-quarter inch are shingled first by said shroud member and thereafter by said separator wheel and are then dispensed from said sheet feeder.

2. The sheet feeder of claim 1, wherein said separator wheel is nonrotationally mounted.

3. The sheet feeder of claim 1, wherein said separator wheel is rotationally mounted.

4. The sheet feeder of claim 3, wherein said separator wheel is mounted for rotation in a direction counter to a direction of said articles as they enter into said nip area.

5. The sheet feeder of claim 4, wherein said separator wheel rotates at a speed of about eight thousandths of an inch per second.

* * * * *